US007540723B2

(12) United States Patent
Song et al.

(10) Patent No.: US 7,540,723 B2
(45) Date of Patent: Jun. 2, 2009

(54) RECIPROCATING COMPRESSOR

(75) Inventors: Gye Young Song, Gyeonggi-Do (KR); Jong Koo Lee, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 497 days.

(21) Appl. No.: 10/893,290

(22) Filed: Jul. 19, 2004

(65) Prior Publication Data

US 2005/0142009 A1 Jun. 30, 2005

(30) Foreign Application Priority Data

Dec. 29, 2003 (KR) ..... 10-2003-0099280

(51) Int. Cl.
*F04B 17/00* (2006.01)
*F04B 35/04* (2006.01)

(52) U.S. Cl. ..... 417/363; 417/416; 417/902

(58) Field of Classification Search ..... 417/417, 417/363; 92/153

See application file for complete search history.

(56) References Cited

U.S. PATENT DOCUMENTS

| | | | | |
|---|---|---|---|---|
| 5,704,771 | A | 1/1998 | Fujisawa et al. | |
| 6,089,352 | A | 7/2000 | Kim et al. | |
| 6,202,791 | B1 * | 3/2001 | Oh et al. | 184/6.16 |
| 2001/0043870 | A1 * | 11/2001 | Song | 417/363 |
| 2002/0176790 | A1 * | 11/2002 | Akazawa et al. | 417/417 |
| 2003/0017064 | A1 * | 1/2003 | Kawahara et al. | 417/417 |
| 2003/0156956 | A1 * | 8/2003 | Park et al. | 417/416 |

FOREIGN PATENT DOCUMENTS

| | | | |
|---|---|---|---|
| AU | 32359 | | 2/1973 |
| CN | 1152079 | | 6/1997 |
| DE | 2143839 | | 3/1972 |
| DE | 2435829 | A1 | 2/1976 |
| DE | 19825414 | | 12/1999 |
| GB | 2266932 | A * | 11/1993 |
| WO | 00/17585 | | 3/2000 |
| WO | WO 0220990 | A1 * | 3/2002 |

OTHER PUBLICATIONS

English Language Abstract of DE 19825414.
English language Abstract of CN 1152079.
English language Abstract of DE 2435829 A1.

* cited by examiner

*Primary Examiner*—Devon C Kramer
*Assistant Examiner*—Patrick Hamo
(74) *Attorney, Agent, or Firm*—Greenblum & Bernstein, P.L.C.

(57) ABSTRACT

A reciprocating compressor includes a reciprocating motor that generates a reciprocation force and a compressing unit to which a discharge pipe that discharges a compressed fluid is connected. The compressing unit compresses a fluid by receiving the reciprocation force generated by the reciprocating motor. A frame, to which the reciprocating motor and the compressing unit are fixed, is connected to a suction pipe that sucks a fluid to be compressed at one side thereof, and that contains lubricating oil therein.

24 Claims, 6 Drawing Sheets

RECIPROCATING COMPRESSOR

RELATED APPLICATIONS

The present disclosure relates to subject matter contained in Korean Application No. 10-2003-0099280, filed on Dec. 29, 2003, which is herein expressly incorporated by reference in its entirety.

BACKGROUND OF THE INVENTION

1. Field of the Invention

The present invention relates to a reciprocating compressor, and more particularly, to a reciprocating compressor configured to reduce a fabrication cost by simplifying a supply structure of lubricating oil.

2. Description of the Conventional Art

Generally, compressors are classified as a rotary compressor, a reciprocating compressor, a scroll compressor, and etc. according to a compression method of a fluid.

FIG. 1 is a sectional view showing a reciprocating compressor in accordance with the conventional art.

The conventional reciprocating compressor comprises: a hermetically sealed case 106 to which a suction pipe 102 and a discharge pipe 104 are connected; a reciprocating motor 108 disposed in the case 106 for generating a reciprocation force; a compressing unit 110 for compressing a fluid by receiving the reciprocation force generated by the reciprocating motor 108 and a lubricating unit 112 for supplying lubricating oil to each frictional generating part of the compressor; and etc.

The reciprocating motor 108 includes: an outer stator 118 of a cylindrical shape fixed between a second frame 114 and a third frame 116; an inner stator 120 disposed at an inner circumferential surface of the outer stator 118 and spaced therefrom by a certain air gap; a winding coil 122 disposed inside the outer stator 118 and to which an external power is applied; and a magnet 124 disposed between the outer stator 118 and the inner stator 120 and linearly reciprocating when power is applied to the winding coil 122.

The magnet 124 is fixed to an outer circumferential surface of a magnet holder 126, and the magnet holder 126 is connected to a piston 128 of the compressing unit 110. The piston 128 is connected to a spring supporter 130.

A first resonant spring 134 and a second resonant spring 136 are respectively disposed between one side surface of the spring supporter 130 and the first frame 132 and between another side surface of the spring supporter 130 and the second frame 114, thereby inducing a resonant movement of the piston 128.

The compressing unit 110 includes the piston 128 connected to the magnet holder 126 and linearly reciprocated; a cylinder 142 within which the piston 128 is slidably inserted, forming a compression chamber 140, and fixed to the first frame 132; a suction valve 146 mounted at the front side of the piston 128 for opening and closing an inlet 144 formed in the piston 128; and a discharge valve assembly 148 mounted at the front side of the cylinder 142 for discharging a compressed fluid externally when a pressure inside the compression chamber 140 is more than a preset pressure.

The discharge valve assembly 148 includes: a discharge valve 150 mounted to the front side surface of the cylinder 142 for discharging a compressed fluid; a discharge cover 154 mounted at the front side of the cylinder 142 and to which a discharge pipe 152 for discharging a fluid is connected; and a spring 156 disposed between the inner side surface of the discharge cover 154 and the discharge valve 150 for elastically supporting the discharge valve 150.

A first supporting spring 158 is disposed between the third frame 116 and the upper surface of the case 106, and a second supporting spring 160 is disposed between the discharge cover 154 and the lower surface of the case 106.

As shown in FIG. 2, the lubricating unit is provided for supplying lubricating oil contained at the lower portion of the case 106 to sliding surfaces between the cylinder 142 and the piston 128. The lubricating unit includes: a pumping unit 162 fixed at one side of the first frame 132, for pumping lubricating oil by using vibration generated at the time of driving the compressor; an opening/closing valve 164 for opening and closing a passage for the lubricating oil pumped by the pumping unit 162; and a lubricating oil passage 166 formed at the first frame 132 for supplying lubricating oil to the sliding surfaces between the cylinder 142 and the piston 128.

The pumping unit 162 includes: a lubricating cylinder 168 fixed at one side of the first frame 132; a lubricating piston 170 linear-movably disposed in the lubricating cylinder 168 and reciprocated by vibration of the compressor, for pumping lubricating oil; two springs 172 for elastically supporting the opposite sides of the lubricating piston 170; and a suction pipe 174 for sucking lubricating oil contained in the lower portion of the case 106.

The opening/closing valve 164 is disposed between the front side of the cylinder 142 and the lubricating oil passage 166 to thus suck lubricating oil into the suction pipe 174 in accordance with a reciprocation of the piston 170 and to supply the sucked lubricating oil to the lubricating oil passage 166.

The lubricating unit of the conventional compressor will now be explained. The lubricating piston 170 is reciprocated inside the lubricating cylinder 168 by a vibration generated when the compressor is driven. By a pressure generated by the reciprocation of the lubricating piston 170, lubricating oil is sucked through the suction pipe 174.

The lubricating oil sucked into the suction pipe 174 is compressed by an open/close operation of the opening/closing valve 164 thus to be supplied to the frictional surfaces between the cylinder 142 and the piston 128 through the lubricating oil passage 166.

However, since the lubricating unit of the conventional reciprocating compressor includes a plurality of components such as the pumping unit for pumping lubricating oil, the opening/closing valve for opening and closing a passage of lubricating oil pumped by the pumping unit, and etc., the structure is complicated. According to this, the entire structure of the compressor becomes complicated and a fabrication cost is increased.

Also, the pumping unit is not driven when the compressor is stopped, so that lubricating oil is collected into the lower portion of the case. According to this, there is insufficient lubricating oil at the frictional surfaces between the cylinder and the piston during an initial driving of the compressor, thereby resulting in abrasion at the frictional surfaces.

SUMMARY OF THE INVENTION

Therefore, an object of the present invention is to provide a reciprocating compressor capable of simplifying an entire structure of a compressor and reducing a fabrication cost by simplifying a lubricating oil supply passage.

Another object of the present invention is to provide a reciprocating compressor capable of enhancing a lubricating performance by ensuring that lubricating oil is always present at frictional surfaces of a compressor.

To achieve these and other advantages and in accordance with the purpose of the present invention, as embodied and broadly described herein, there is provided a reciprocating compressor including a case having a hermetically sealed space and to which a suction pipe for sucking a fluid and a discharge pipe for discharging a compressed fluid are connected.

A reciprocating motor is disposed in the case for generating a reciprocation force, a compressing unit is provided for compressing a fluid by receiving the reciprocation force generated from the reciprocating motor, and a frame is provided for supporting the compressing unit and containing lubricating oil supplied to a frictional part of the compressing unit.

The compressing unit includes a piston reciprocated by being connected to the reciprocating motor, and a cylinder within which the piston is slidably inserted. The cylinder is fixed to the frame, and has lubricating oil supply passages for supplying lubricating oil contained in the frame.

The lubricating oil supply passages are formed in the cylinder at equal intervals in a circumferential direction, and are formed lower than a surface of lubricating oil so as to be immersed in the lubricating oil contained in the frame.

The reciprocating compressor includes a reciprocating motor for generating a reciprocation force, and a compressing unit to which a discharge pipe for discharging a compressed fluid is connected, for compressing a fluid by receiving the reciprocation force generated by the reciprocating motor.

The reciprocating motor and the compressing unit are fixed to a frame, and connected to a suction pipe for sucking a fluid to be compressed at one side thereof, and containing lubricating oil therein.

The frame includes a first frame hermetically sealed and fixed to an outer circumferential surface of the cylinder of the compressing unit and containing lubricating oil therein; a second frame coupled to the first frame and fixed to one side of an outer stator of the reciprocating motor; and a third frame coupled to the second frame, to which the outer stator and an inner stator are fixed, and connected to a suction pipe for sucking a fluid at one side thereof.

The frame includes a first frame hermetically sealed and fixed to an outer circumferential surface of the cylinder of the compressing unit, containing lubricating oil therein, and connected to a suction pipe for sucking a fluid at one side thereof; a second frame coupled to the first frame and fixed to one side of the reciprocating motor; and a third frame coupled to the second frame, to which the reciprocating motor is fixed, and having a hermetically sealed upper surface.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate exemplary but non-limiting embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings. Hereinafter, one embodiment of a reciprocating compressor according to the present invention will be explained with reference to the attached drawings.

Even if there may exist a plurality of preferred embodiments of the reciprocating compressor, the most preferable embodiment will be explained.

Figure 1:
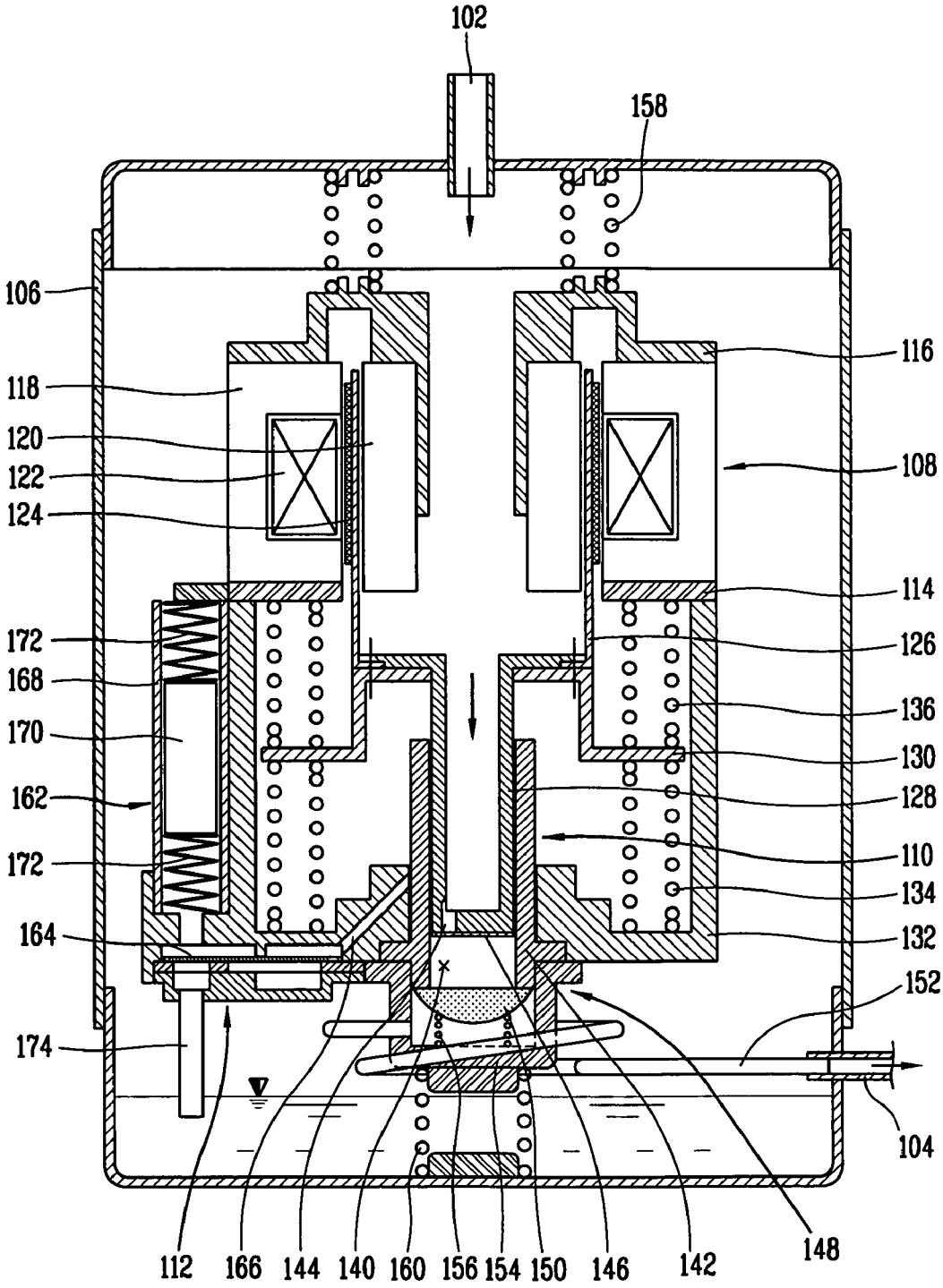
FIG. 1 CONVENTIONAL ART
FIG. 1 is a sectional view showing a reciprocating compressor in accordance with the conventional art.
Figure 2:
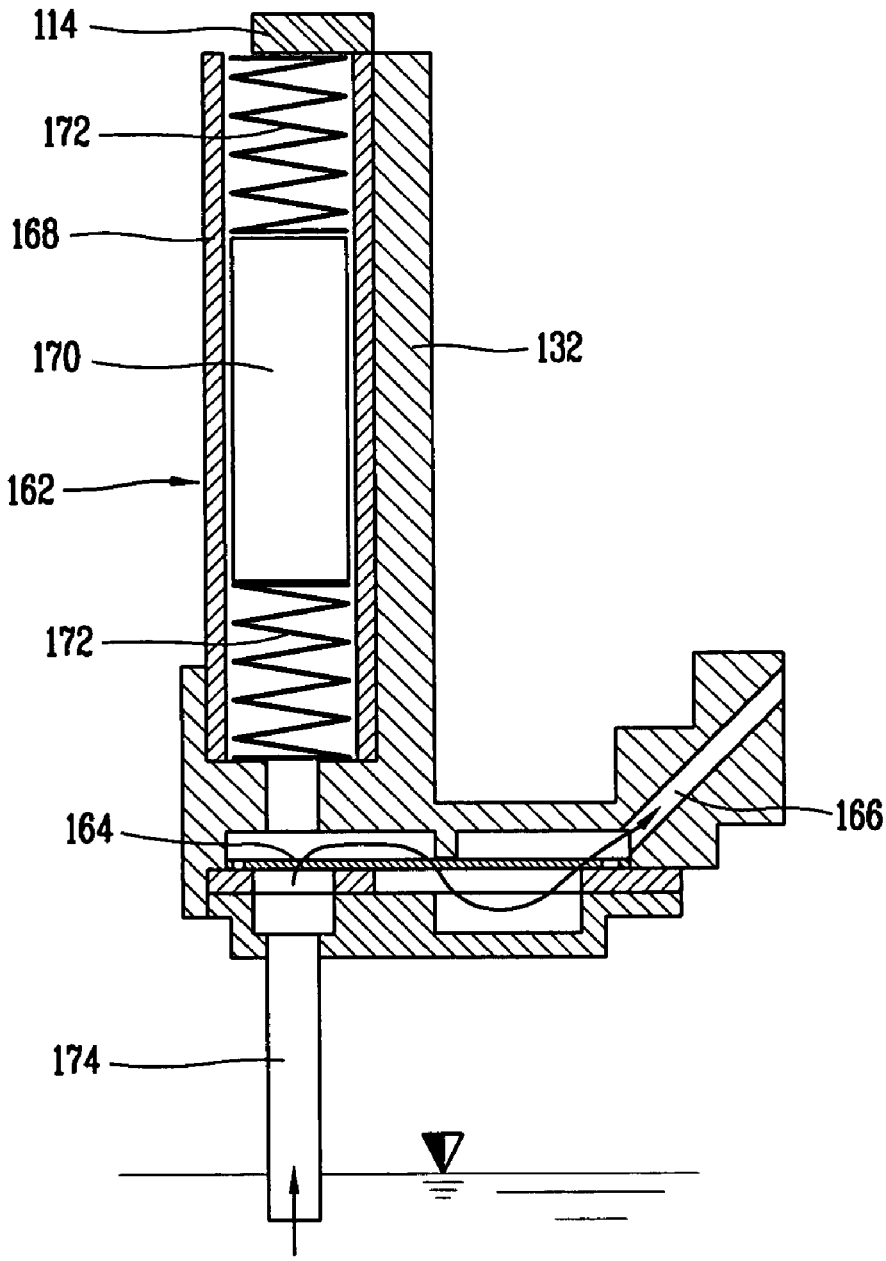
FIG. 2 CONVENTIONAL ART
FIG. 2 is a sectional view showing a lubricating unit of the reciprocating compressor in accordance with the conventional art.
Figure 3:
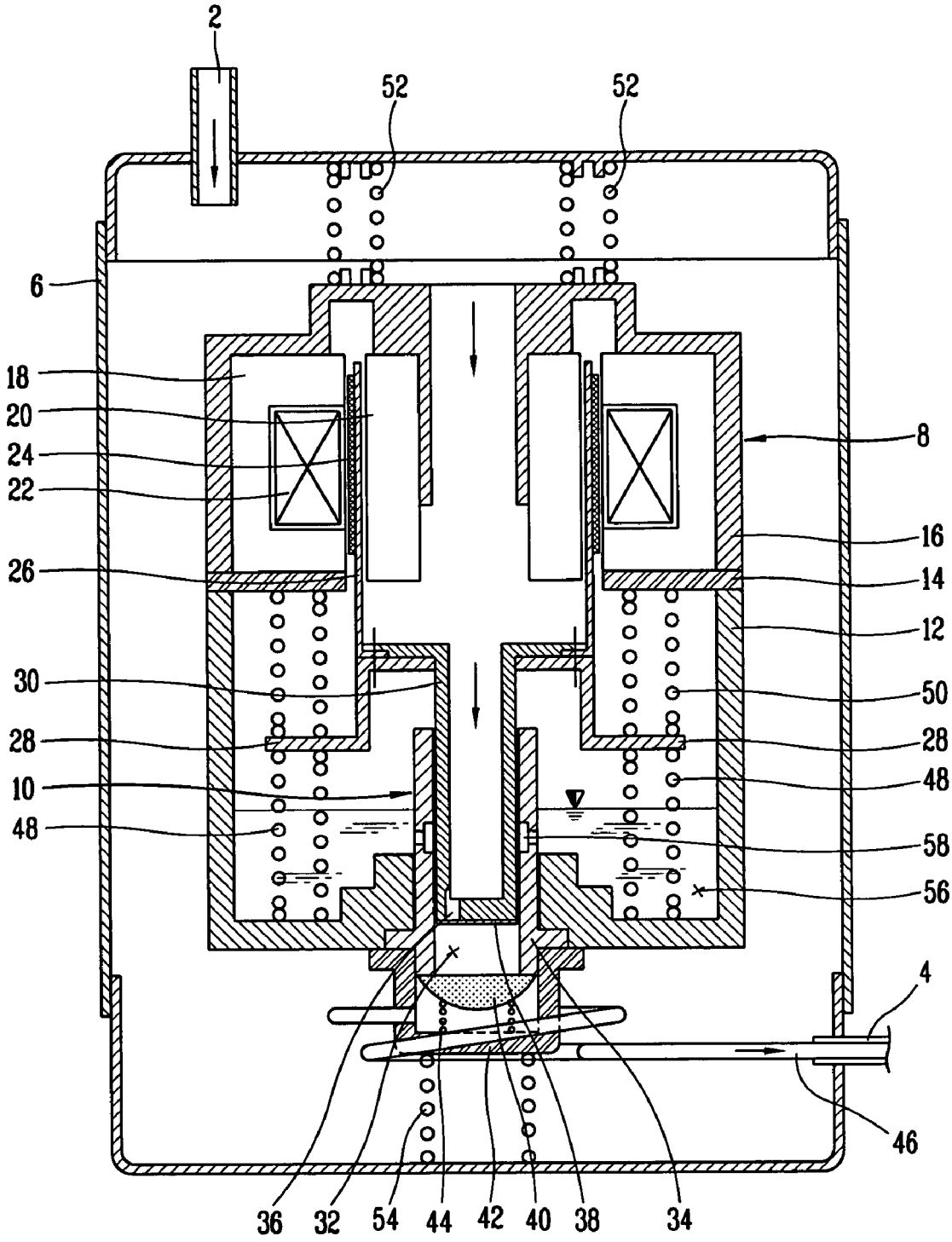
FIG. 3 is a sectional view showing a reciprocating compressor according to one embodiment of the present invention.

FIG. 3 is a sectional view showing a reciprocating compressor according to one embodiment of the present invention.

The reciprocating compressor according to the present invention comprises: a case 6 having a hermetically sealed space and to which a suction pipe 2 for sucking a fluid and a discharge pipe 4 for discharging a compressed fluid are connected; a reciprocating motor 8 disposed in the case 6 for generating a reciprocation force when a power is supplied; a compressing unit 10 for compressing a fluid by receiving the reciprocation force generated by the reciprocating motor 8; and a frame for supporting the reciprocating motor 8 and the compressing unit 10 and containing lubricating oil supplied to frictionally sliding surfaces of the compressing unit.

The reciprocating motor 8 includes: an outer stator 18 of a generally cylindrical shape; an inner stator 20 disposed at an inner circumferential surface of the outer stator 18 with a predetermined air gap therebetween; a winding coil 22 wound either on the outer stator 18 or on the inner stator 20 for forming a flux between the outer stator 18 and the inner stator 20 when power is applied; and a magnet 24 disposed within an air gap between the outer stator 18 and the inner stator 20.

The magnet 24 is fixed to an outer circumferential surface of a magnet holder 26, and the magnet holder 26 is connected to a spring supporting bar 28 and a piston 30 of the compressing unit 10.

The compressing unit 10 includes: a piston 30 reciprocated as a result of being connected to the magnet holder 26; a cylinder 34 within which the piston 30 is slidably inserted and forming a compression chamber 32; a suction valve 38 mounted at the front side of the piston 30 for opening and closing an inlet 36 formed at the piston 30; and a discharge valve assembly mounted at the front side of the cylinder 34 for opening and closing an outlet of a fluid.

The discharge valve assembly includes: a discharge valve 40 mounted to the front side surface of the cylinder 34 for discharging a compressed fluid; a discharge cover 42 mounted at the front side of the cylinder 34 and connected to a discharge pipe 46 at one side thereof and a spring 44 disposed between the inner side surface of the discharge cover 42 and the discharge valve 40 for elastically supporting the discharge valve 40.

The frame includes: a first frame 12 fixed to an outer circumferential surface of the cylinder 34 for supporting the cylinder 34; a second frame 14 coupled to the first frame 12 for supporting one side surface of the outer stator 18; and a third frame 16 coupled to the second frame 14 and fixed to an outer circumferential surface of the outer stator 18, for supporting the reciprocating motor 8.

A first resonant spring 48 is disposed between the front surface of the spring supporting bar 28 and the first frame 12 to thus apply an elastic force to the piston 30 when the piston 30 is retracted, and a second resonant spring 50 is disposed between the rear surface of the spring supporting bar 28 and the second frame 14 to thus apply an elastic force to the piston 30 when the piston 30 is advanced.

A first supporting spring (or springs) 52 is disposed between the third frame 16 and the upper surface of the case 6, and a second supporting spring 54 is disposed between the discharge cover 42 and the lower surface of the case 6, thereby shock-absorbingly supporting the case 6 and the components mounted in the case 6.

Figure 4:
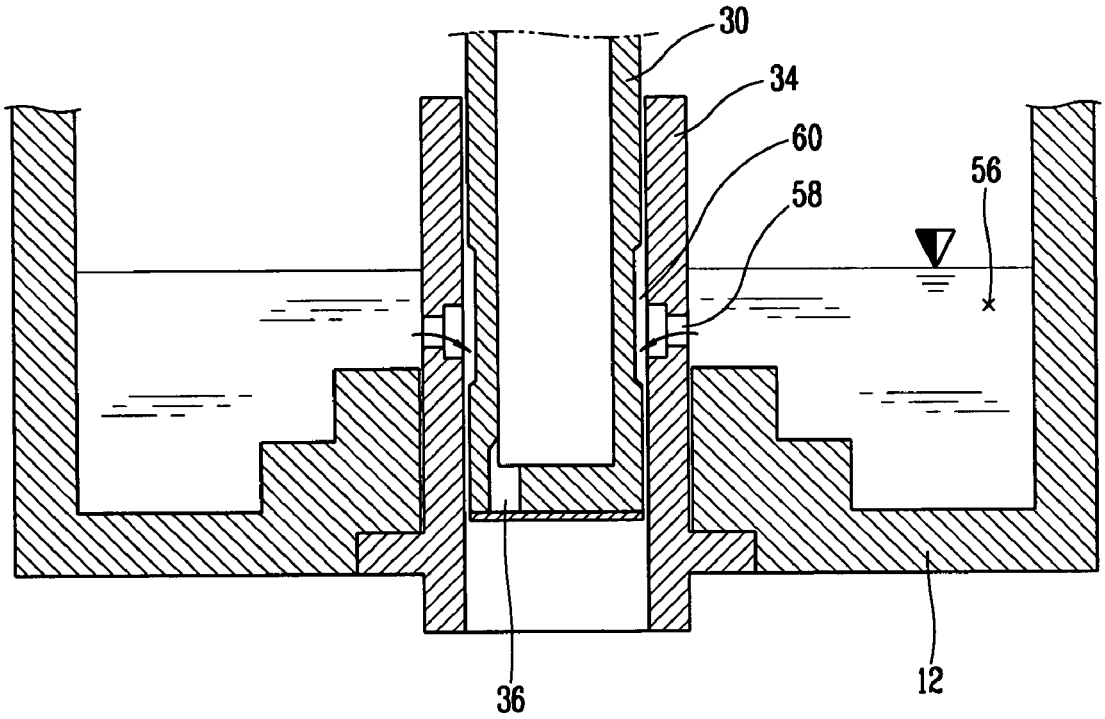
FIG. 4 is an enlarged sectional view showing a lubricating oil supply structure of the reciprocating compressor according to one embodiment of the present invention.

FIG. 4 is an enlarged sectional view showing a lubricating oil supply structure of the reciprocating compressor according to one embodiment of the present invention.

The first frame 12 is formed to have, e.g., a cylindrical shape. The upper side of the first frame is fixed to the second frame 14, and the lower side thereof is hermetically fixed to the outer circumferential surface of the cylinder 34, thereby providing a lubricating oil storage space 56 therein for containing lubricating oil.

The cylinder 34 is provided with lubricating oil supply passages 58 for supplying the lubricating oil stored in the first frame 12 to frictional sliding surfaces between the cylinder 34 and the piston 30.

The lubricating oil supply passages 58 are formed at the cylinder 34 spaced in a circumferential direction at regular intervals, and are formed lower than a surface of the lubricating oil contained in the first frame 12 so as to be immersed in the lubricating oil. While a plurality of oil supply passages are described, even a single oil supply passage is included in the scope of the present invention. Nor is any significance attached to the number of passages provided.

An oil pocket 60 for storing the lubricating oil supplied to the lubricating oil supply passages 58 is formed at the outer circumferential surface of the piston 30.

A lubricating operation of the reciprocating compressor according to the present invention will now be explained.

First, the first frame 12 and the cylinder 34 are assembled to each other in a sealed state, and lubricating oil is provided in the first frame 12. According to this, the lubricating oil stored in the first frame 12 is supplied to a frictional sliding surface between the cylinder 34 and the piston 30 through the lubricating oil supply passages 58 formed at the cylinder 34, thereby performing a lubricating operation.

Herein, since the lubricating oil supply passages 58 are formed at a lower position than the surface of the lubricating oil, the lubricating oil can be supplied to between the cylinder 34 and the piston 30 at all times regardless of the driving or operation condition of the compressor.

Figure 5:
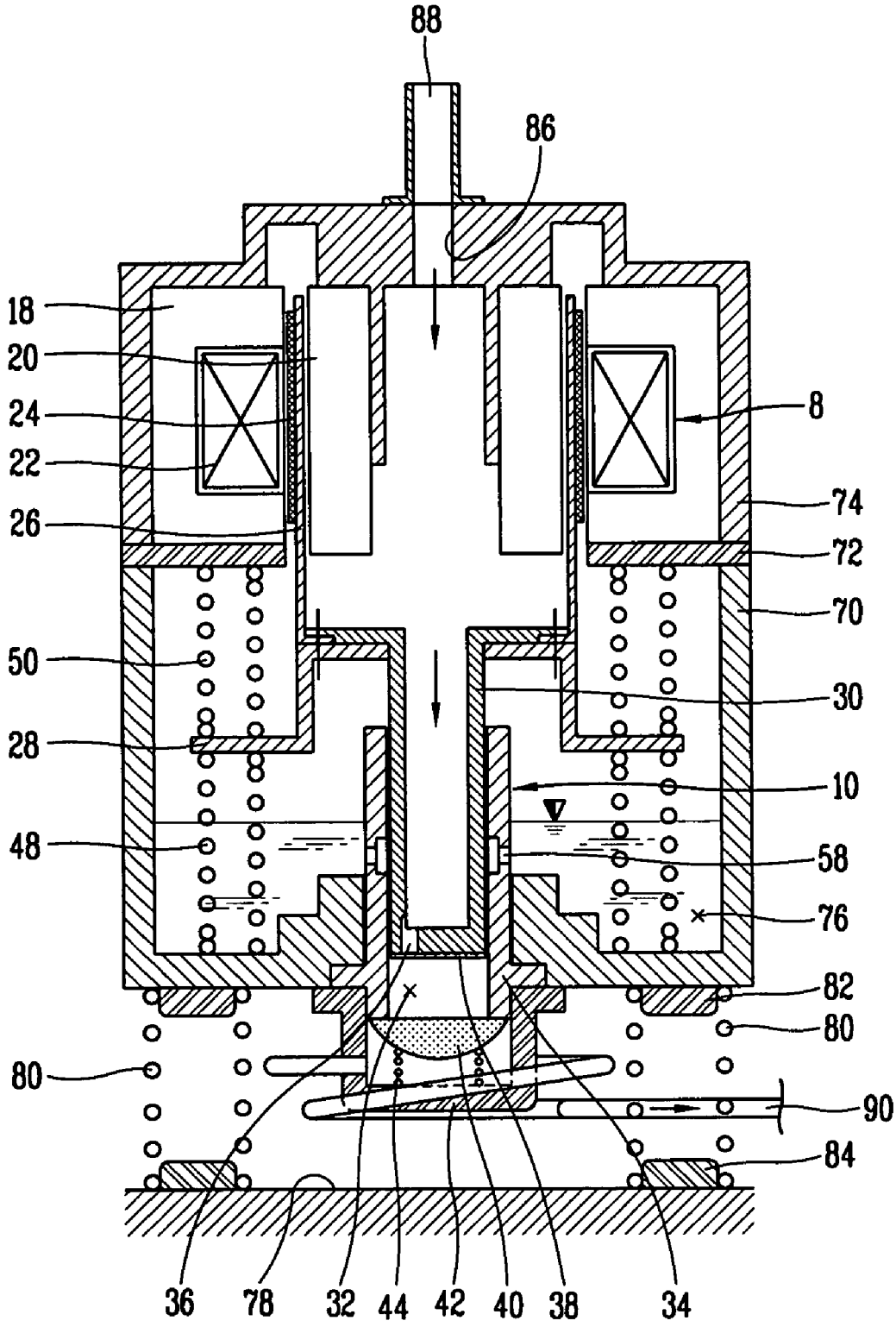
FIG. 5 is a sectional view showing a reciprocating compressor according to a second embodiment of the present invention.

FIG. 5 is a sectional view showing a reciprocating compressor according to a second embodiment of the present invention.

The reciprocating compressor according to the second embodiment comprises: a reciprocating motor 8 for generating a reciprocation force; a compressing unit 10, to which a discharge pipe 90 for discharging a compressed fluid outwardly is connected, for compressing a fluid by receiving the reciprocation force generated by the reciprocating motor 8; and a frame to which the reciprocating motor 8 and the compressing unit 10 are fixed.

The reciprocating motor 8 and the compressing unit 10 have the same constructions as those of the first embodiment, thereby the explanations of these components will be omitted.

The frame includes: a first frame 70 hermetically fixed (i.e., sealed) to the outer circumferential surface of the cylinder 34 of the compressing unit 10 and containing lubricating oil therein; a second frame 72 coupled to the first frame 70 and fixed to one side of an outer stator 18 of the reciprocating motor 8; and a third frame 74 coupled to the second frame 72 and to which the reciprocating motor 8 is fixed.

The first frame 70 is formed to have, e.g., a cylindrical shape, and the lower side thereof is hermetically fixed (or sealed) to the outer circumferential surface of the cylinder 34 to thus provide a lubricating oil storage space 76.

A supporting spring (or springs) 80 for shock-absorbingly supporting the compressor is disposed between the lower surface of the first frame 70 and a bottom surface 78 on which the compressor is installed.

A plurality of the supporting springs 80 are installed at the lower surface of the first frame 70 spaced from each other by a certain interval, an upper spring seat 82 for fixing the upper side of each supporting spring 80 is formed at the lower surface of the first frame 70, and a lower spring seat 84 for fixing the lower side of each supporting spring 80 is formed at the bottom surface 78.

A fluid supply passage 86 for supplying a fluid to be compressed to the compressing unit 10 is formed at the upper side of the third frame 74, and a suction pipe 88 for sucking a fluid is connected to the fluid supply passage 86.

In the reciprocating compressor according to the second embodiment, a fluid is sucked in through the suction pipe 88 connected to the third frame 74. The fluid sucked through the suction pipe 88 is supplied to the compressing unit 10 through the fluid supply passage 86 formed at the third frame 74 to thus be compressed. Then, the compressed fluid is discharged outwardly through the discharge pipe 90 connected to the compressing unit 10.

The lubricating oil stored in the first frame 70 is supplied to a frictional sliding surface between the cylinder 34 and the piston 30 through the lubricating oil supply passage 58 formed at the cylinder 34, thereby performing the lubricating operation.

Figure 6:
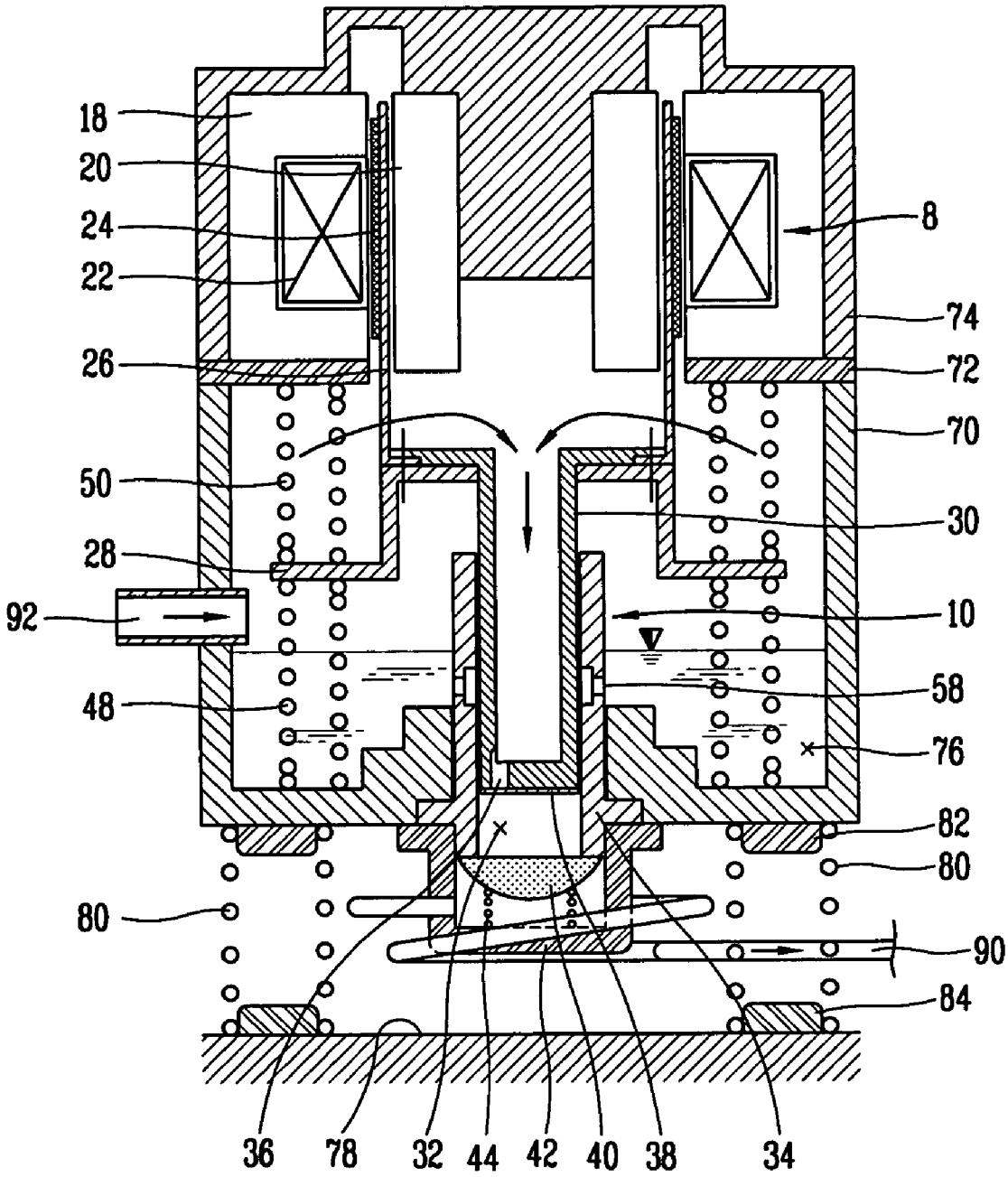
FIG. 6 is a sectional view showing a reciprocating compressor according to a third embodiment of the present invention.

FIG. 6 is a sectional view showing a reciprocating compressor according to a third embodiment of the present invention.

The reciprocating compressor according to the third embodiment has the same construction as the reciprocating compressor according to the second embodiment except that a suction pipe 92 for sucking a fluid is connected to the first frame 70.

That is, the upper side of the third frame 74 according to the third embodiment covers the reciprocating motor 8 in a hermetic (i.e., sealed) state. A suction pipe 92 for sucking a fluid is connected to one side of the first frame 70. The suction pipe 92 is installed at a position higher than the surface of the lubricating oil, so that a sucked fluid is not interfered with by the lubricating oil.

In the reciprocating compressor according to the present invention, lubricating oil is stored in the frame and the lubricating oil supply passage formed at the cylinder is immersed in the lubricating oil, thereby supplying the lubricating oil to the frictional sliding surfaces between the piston and the cylinder through the lubricating oil supply passage. Therefore, an additional component for pumping the lubricating oil is not necessary thus simplifying the structure, reducing the size of the compressor, and reducing a fabrication cost.

Also, since the suction pipe for sucking a fluid is directly installed in the frame and the lubricating oil is contained in the frame, an additional case is not necessary. Accordingly, the fabrication cost is reduced and the size of the compressor is reduced.

Additionally, the lubricating oil supply passage is always in a state of being immersed in the lubricating oil, thereby preventing the lubricating oil from being absent from the frictional sliding surfaces between the piston and the cylinder upon the initial driving of the compressor. Accordingly, the lubricating performance can be enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A reciprocating compressor comprising:

a case having a hermetically sealed space and to which a suction pipe that sucks a fluid and a discharge pipe that discharges a compressed fluid are connected;

a reciprocating motor disposed in the case that generates a reciprocation force;

a compressing unit compressing a fluid by receiving the reciprocation force generated by the reciprocating motor and comprising a cylinder having a plurality of lubricating oil supply passages extending through a wall of the cylinder and supported by a frame;

the frame comprising;

a first frame, hermetically fixed to an outer circumferential surface of the cylinder of the compressing unit, containing lubricating oil therein, and connected to a suction pipe that sucks a fluid;

a second frame coupled to the first frame and fixed to one side of the reciprocating motor; and a third frame coupled to the second frame, to which the reciprocating motor is fixed, and having a hermetically sealed upper surface;

the plurality of lubricating oil supply passages in open communication with a lubricating oil reservoir and which supplies lubricating oil contained in the first frame to a frictionally sliding surface of the compressing unit, wherein the lubricating oil supply passages are on the cylinder at a position lower along an axial direction of the cylinder than a free surface of the lubricating oil in the lubricating oil reservoir.

2. The reciprocating compressor of claim 1, wherein the compressing unit comprises:

a piston reciprocated by being connected to the reciprocating motor and slidably inserted within the cylinder.

3. The reciprocating compressor of claim 2, wherein the lubricating oil supply passages are formed in the cylinder spaced in a circumferential direction at regular intervals.

4. The reciprocating compressor of claim 2, wherein an oil pocket that stores lubricating oil supplied to the lubricating oil supply passages is formed at an outer circumferential surface of the piston.

5. The reciprocating compressor of claim 2, wherein the first frame comprises a cylindrical shape and the lubricating oil reservoir is formed in a lower side of the first frame hermetically fixed to an outer circumferential surface of the cylinder.

6. A reciprocating compressor comprising:

a reciprocating motor that generates a reciprocation force;

a compressing unit that comprises a cylinder and a piston reciprocated by being connected to the reciprocating motor and slidably inserted within the cylinder and connects with a discharge pipe that discharges a compressed fluid and that compresses a fluid by receiving the reciprocation force generated from the reciprocating motor; and a frame containing lubricating oil therein, to which the reciprocating motor and the compressing unit are fixed, wherein a suction pipe that sucks a fluid to be compressed is connected at one side of the frame such that fluid enters the frame at a position higher than a free surface of the lubricating oil, and wherein the frame comprises:

a first frame hermetically fixed to an outer circumferential surface of the cylinder of the compressing unit, containing lubricating oil therein;

a second frame coupled to the first frame and fixed to one side of the reciprocating motor: and a third frame coupled to the second frame, to which the reciprocating motor is fixed, and having a hermetically sealed upper surface.

7. The reciprocating compressor of claim 6, wherein an outer stator and an inner stator of the reciprocating motor are fixed to the third frame, and wherein the third frame is connected to the suction pipe an upper side of the third frame.

8. The reciprocating compressor of claim 7, wherein the first frame has a cylindrical shape and a lower side thereof is hermetically fixed to an outer circumferential surface of the cylinder thereby to form a lubricating oil storage space therein that stores the lubricating oil.

9. The reciprocating compressor of claim 8, wherein the cylinder is provided with lubricating oil supply passages that supply the lubricating oil contained in the frame to a frictional sliding surface between the cylinder and the piston.

10. The reciprocating compressor of claim 9, wherein the lubricating oil supply passages are formed at the cylinder spaced in a circumferential direction at regular intervals, and are disposed lower than a surface of the lubricating oil.

11. The reciprocating compressor of claim 8, wherein a supporting spring that shock-absorbingly supports the compressor is disposed between a lower surface of the first frame and a surface on which the compressor is positioned.

12. The reciprocating compressor of claim 11, wherein a plurality of supporting springs are provided at the lower surface of the first frame spaced by a predetermined interval, an upper spring seat that fixes an upper side of the supporting spring is formed at the lower surface of the first frame, and a lower spring seat that fixes a lower side of the supporting spring is formed at the surface on which the compressor is positioned.

13. The reciprocating compressor of claim 6, wherein a suction pipe that sucks a fluid to be compressed is connected at one side of the frame such that fluid enters the first frame at a position higher at a free surface of the lubricating oil and in a direction generally orthogonal to the reciprocation force.

14. The reciprocating compressor of claim 13, wherein the first frame comprises a cylindrical shape, a lower side thereof is hermetically fixed to an outer circumferential surface of the cylinder to form a space therein that contains the lubricating oil, and the suction pipe is installed above a free surface of the lubricating oil.

15. The reciprocating compressor of claim 13, wherein the cylinder is provided with lubricating oil supply passages that supply the lubricating oil contained in the first frame to a frictional sliding surface between the cylinder and the piston.

16. The reciprocating compressor of clam 13, wherein the lubricating oil supply passages are formed in the cylinder spaced in a circumferential direction at regular intervals, and are disposed lower than a surface of the lubricating oil.

17. The reciprocating compressor of claim 14, wherein a supporting spring that shock-absorbingly supports the compressor is disposed between a lower surface of the first frame and a surface on which the compressor is positioned.

18. The reciprocating compressor of claim 17, wherein a plurality of supporting springs are installed at the lower surface of the first frame spaced by a predetermined interval, an upper spring seat that fixes an upper side of the supporting spring is formed at the lower surface of the first frame, and a lower spring seat that fixes a lower side of the supporting spring is formed at the surface.

19. The reciprocating compressor of claim 1, wherein the reciprocating motor comprises:

an outer stator of a cylindrical shape;

an inner stator disposed at an inner circumferential surface of the outer stator and spaced from the outer stator by a predetermined air gap;

a winding coil wound either on the outer stator or on the inner stator that forms a flux between the outer stator and the inner stator when power is supplied; and a magnet disposed in the air gap between the outer stator and the inner stator.

20. The reciprocating compressor of claim 19, wherein the magnet is fixed to an outer circumferential surface of a magnet holder, and the magnet holder is connected to a spring supporting bar and a piston of the compressing unit.

21. The reciprocating compressor of claim 2, wherein the compressing unit further comprises:

a suction valve mounted at a front side of the piston that opens and closes an inlet formed at the piston; and a discharge valve assembly mounted at a front side of the cylinder that opens and closes an outlet of the fluid.

22. The reciprocating compressor of claim 21, wherein the discharge valve assembly comprises:

a discharge valve mounted to a front side surface of the cylinder that discharges the compressed fluid;

a discharge cover mounted at a front side of the cylinder and connected to a discharge pipe at one side thereof and a spring disposed between the inner side surface of the discharge cover and the discharge valve that elastically supports the discharge valve.

23. The reciprocating compressor of claim 2, further comprising:

a first resonant spring disposed between a front surface of a spring supporting bar and the first frame to thus apply an elastic force to the piston when the piston is retracted; and a second resonant spring disposed between a rear surface of the spring supporting bar and the second frame thus to apply an elastic force to the piston when the piston is advanced.

24. The reciprocating compressor of claim 2, further comprising:

a first supporting spring disposed between the third frame and an upper surface of the case; and a second supporting spring disposed between a discharge cover and a lower surface of the case, thereby shock-absorbingly supporting the case and components mounted in the case.

* * * * *